US006192808B1

(12) United States Patent
Bue

(10) Patent No.: US 6,192,808 B1
(45) Date of Patent: Feb. 27, 2001

(54) FOLDING TABLE WITH LATCHING LINKAGE

(75) Inventor: Richard C. Bue, Chaska, MN (US)

(73) Assignee: Sico Incorporated, Minneapolis, MN (US)

( * ) Notice: Subject to any disclaimer, the term of this patent is extended or adjusted under 35 U.S.C. 154(b) by 0 days.

(21) Appl. No.: 09/315,905

(22) Filed: May 20, 1999

(51) Int. Cl.[7] ..... A47B 31/04

(52) U.S. Cl. ..... 108/115; 74/96; 248/122.1; 108/1

(58) Field of Search ..... 108/1, 6, 9, 115; 248/122.1, 124.1, 125.7, 397; 74/96

(56) References Cited

U.S. PATENT DOCUMENTS

| | | | | |
|---|---|---|---|---|
| Re. 24,454 | | 4/1958 | Wilson . | |
| D. 211,886 | | 8/1968 | Benjamin . | |
| 272,243 | * | 2/1883 | Harmony | 108/1 X |
| 770,152 | | 9/1904 | Bechtel . | |
| 988,052 | * | 3/1911 | Vallone | 108/9 X |
| 1,339,232 | | 5/1920 | St. John et al. . | |
| 1,370,732 | | 3/1921 | Corbett . | |
| 1,564,359 | * | 12/1925 | Klein | 108/6 X |
| 1,597,081 | * | 8/1926 | Lyon | 108/9 X |
| 1,599,247 | | 9/1926 | Ridabock . | |
| 1,614,539 | | 1/1927 | Ryan . | |
| 1,891,734 | | 12/1932 | Slee . | |
| 1,924,945 | | 8/1933 | Klotz . | |
| 2,249,455 | | 7/1941 | Caldwell . | |
| 2,258,133 | | 10/1941 | Chuma . | |
| 2,278,817 | | 4/1942 | Zeindler . | |
| 2,368,748 | | 2/1945 | Doty . | |
| 2,508,627 | | 5/1950 | Spiegel et al. . | |
| 2,621,095 | | 12/1952 | Haumerson . | |
| 2,645,539 | | 7/1953 | Thompson . | |
| 2,702,585 | | 2/1955 | Wilson . | |
| 2,721,778 | | 10/1955 | Wilson . | |
| 2,730,417 | | 1/1956 | Mitchell . | |
| 2,739,860 | | 3/1956 | Wilson . | |
| 2,747,958 | | 5/1956 | Wilson . | |
| 2,764,460 | | 9/1956 | Nelson . | |
| 2,766,089 | | 10/1956 | Nielsen . | |
| 2,771,937 | | 11/1956 | Wilson . | |
| 2,782,075 | | 2/1957 | Fagan . | |
| 2,831,741 | | 4/1958 | Wilson . | |
| 2,873,157 | | 2/1959 | Wilson . | |
| 2,887,348 | | 5/1959 | Sadowsky . | |
| 2,977,169 | | 3/1961 | Geller . | |
| 2,993,740 | | 7/1961 | Good . | |
| 3,027,209 | | 3/1962 | Nielsen . | |

(List continued on next page.)

FOREIGN PATENT DOCUMENTS

| | | | | |
|---|---|---|---|---|
| 1176323 | | 4/1959 | (FR) . | |
| 149112 | * | 8/1920 | (GB) | 108/115 X |

*Primary Examiner*—Janet M. Wilkens
*Assistant Examiner*—Michael J. Fisher
(74) *Attorney, Agent, or Firm*—Merchant & Gould P.C.

(57) ABSTRACT

A folding table includes a folding table top and a framework typically mounted on casters or rollers. A linkage provides for folding of the table top between a use position wherein the table top is substantially horizontal and a storage position wherein the tabletop is substantially vertical. The linkage includes a table top frame member having a slot and c-channel formed therein slidably mounted on a pivot at a top of the framework. A linkage arm extends between one end of the table top frame member and the frame. A latch pivotally mounts to the table top frame member and moves between an engaged and disengaged position wherein the frame pivot is retained. A latch holder also slidably mounts on the table top frame member and is selectively engageable with a lift surface of the latch member to lift the latch out of engagement with the pivot.

18 Claims, 6 Drawing Sheets

U.S. PATENT DOCUMENTS

| | | | | |
|---|---|---|---|---|
| 3,028,197 | | 4/1962 | Wilson . | |
| 3,034,843 | | 5/1962 | Moon . | |
| 3,055,705 | | 9/1962 | Wilson . | |
| 3,080,833 | | 3/1963 | Risdall . | |
| 3,099,480 | | 7/1963 | Wilson . | |
| 3,099,481 | | 7/1963 | Bue . | |
| 3,101,064 | | 8/1963 | Kanzelberger et al. . | |
| 3,109,678 | | 11/1963 | Wilson . | |
| 3,143,982 | | 8/1964 | Blink et al. . | |
| 3,212,463 | | 10/1965 | Anderson et al. . | |
| 3,245,363 | | 4/1966 | Amthor, Jr. et al. . | |
| 3,276,401 | | 10/1966 | Wilson et al. . | |
| 3,337,262 | | 8/1967 | Katzfey et al. . | |
| 3,425,365 | * | 2/1969 | Thoreson et al. | 108/1 X |
| 3,437,058 | | 4/1969 | Bue . | |
| 3,476,061 | | 11/1969 | Takahashi . | |
| 3,557,720 | | 1/1971 | Blink et al. . | |
| 3,580,632 | | 5/1971 | Seymour . | |
| 3,715,143 | | 2/1973 | Gerken et al. . | |
| 3,799,073 | | 3/1974 | Nielsen . | |
| 3,861,325 | | 1/1975 | Bue et al. . | |
| 4,052,100 | | 10/1977 | Nikitits et al. . | |
| 4,070,057 | | 1/1978 | Jones . | |
| 4,131,311 | | 12/1978 | Nikitits et al. . | |
| 4,133,271 | | 1/1979 | Carlson . | |
| 4,249,773 | | 2/1981 | Giambalvo . | |
| 4,590,865 | | 5/1986 | Rütsche et al. . | |
| 4,596,196 | | 6/1986 | Gunter et al. . | |
| 4,615,279 | | 10/1986 | de la Haye . | |
| 4,627,364 | | 12/1986 | Klein et al. . | |
| 4,653,804 | | 3/1987 | Yoo et al. . | |
| 4,669,694 | * | 6/1987 | Malick | 248/397 |
| 4,700,987 | | 10/1987 | Sraka et al. . | |
| 4,779,878 | | 10/1988 | Betts et al. . | |
| 4,826,244 | | 5/1989 | Choi . | |
| 4,879,954 | * | 11/1989 | Harmony | 108/1 X |
| 4,883,314 | | 11/1989 | Sakong . | |
| 4,932,333 | | 6/1990 | Jensen et al. . | |
| 5,367,963 | | 11/1994 | Jäggi et al. . | |

* cited by examiner

FOLDING TABLE WITH LATCHING LINKAGE

BACKGROUND OF THE INVENTION

1. Field of the Invention

The present invention relates to a folding table, and in particular, to a folding table having an improved latching linkage.

2. Prior Art

Tables which having a folding table top, such as room service tables, are well known. Such tables typically have a frame that may be mounted on casters for rolling from location to location. When not in use, the table tops may fold to a substantially vertical position. When the table top is moved to a vertical orientation, the tables may be placed together in a nested configuration, so that less floor space is required for storage. The frames typically include a central vertical member which engages the table top at the center of the opposite ends of the table, and provides for nesting the folded tables.

To facilitate folding, linkages are known that provide motion for moving the table top between the folded vertical position and the unfolded substantially horizontal position. The folding linkages also provide an extension of the framework to the underside of the table top for added bracing at each end of the table. This bracing becomes especially important when heavier loads are placed on the table. In addition, where the table has substantial length, greater bracing is needed to support the larger area.

The folding linkage required latching the linkage in the unfolded position to provide rigid support for the table top in a substantially horizontal orientation. The tables preferably have a linkage at each end of the table top for each vertical frame member associated with each end of the table. To provide added stability, it is preferable that both linkages are latchable in the use position.

Such tables are shown on U.S. Pat. No. 4,750,430 to McNamara, and U.S. Pat. No. 3,437,058 to Bue, both assigned to SICO Incorporated, the assignee of the present invention. Although the McNamara and Bue tables provide a useful table that folds for easy storage, the latching of such a table may be improved. The folding linkage on such tables of the table top must be separately actuated. If the tables have a single lock, the end without the lock may have less support and not provide the desired stability. If latches mirroring one another are placed at both ends, they typically must be held open separately to disengage. Therefore, two people may be required to fold the table, as both latch members must be held to disengage. It could be appreciated that a connecting member may extend between the two latches so that actuation of one latch will actuate the other. However, where the table has an extended length, the torque and twisting placed on the connecting member may be unacceptable, making the actuation of both latches difficult.

It can be seen then that a new and improved folding linkage for a folding table is needed. Such a linkage should provide for latching at both ends of a dual linkage system having folding motions that mirror one another. In addition, such a linkage should provide for actuation latching and unlatching by one person. Latching should be accomplished without having torsional forces and associated strain placed on a connecting member between mirrored latch members. The present invention addresses these, as well as other problems associated with folding linkages.

SUMMARY OF THE INVENTION

The present invention is directed to a folding table, and in particular to a folding table having a latchable linkage.

Folding tables such as those used in the hotel industry are used to deliver room service meals to guests and provide tables for eating meals upon delivery. Such tables are mounted on casters including a frame supporting the folding table top. The table top folds between a substantially horizontal orientation in the use position and a substantially vertical orientation in the storage position.

The present invention includes a latchable folding linkage. The linkage includes a table top frame member also acting as a link mounted to the underside of the folding table top. The table top frame member includes a slot formed along a portion of the frame member and c-channel running substantially the length of the frame member. The folding table frame includes an upright member having a pivot member mounted at a top end thereof. The pivot member includes a sliding block mounting in the c-channel of the table top frame member so that the pivot slides in the slot of the table top frame member. This provides for sliding the table top on the pivot member between the folded storage position and unfolded use position.

A support arm pivotally mounts to the extended end of the table top frame member and to the upright portion of the supporting frame and provides added bracing to the table top. The folding table top generally includes two folding linkages, with at least one of the linkages includes a latch. The latch pivotally attaches to the table top frame member and can be moved between an engaged position wherein it retains the pivot member of the upright member of the frame, and a disengaged position allowing refolding. The latch member includes a retaining portion and engages the pivot on a lift surface. A latch holder slidably mounts to the frame member and includes a strut extending through the slot. These struts can be slid to engage the lift surface of the latch member and move the latch to a lifted disengaged position. During folding, both the pivot and the latch holder slide within the same slot and slide along the c-channel.

To actuate the folding table from the folded position to the use position, the lower edge of the table top is lifted upward. As the pivot moves along the slot, it lifts the latch and slides along with it until a hook portion of the latch engages the pivot. To fold the table from the use position to the storage position without having an operator holding both of the latches open, the latch holder must be slid until engaging the lift surface of the latch. When the latch has been lifted to a position disengaging the pivot to the frame, the second linkage may be manually lifted so that both latches are disengaged. At this position, the table top may be folded to the vertical position. The non-manually actuated latch is held in the disengaged position by the latch holder, thereby allowing a single person to fold and unfold the table.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structure throughout the several views.

DETAILED DESCRIPTION OF THE PREFERRED EMBODIMENTS

Figure 1:
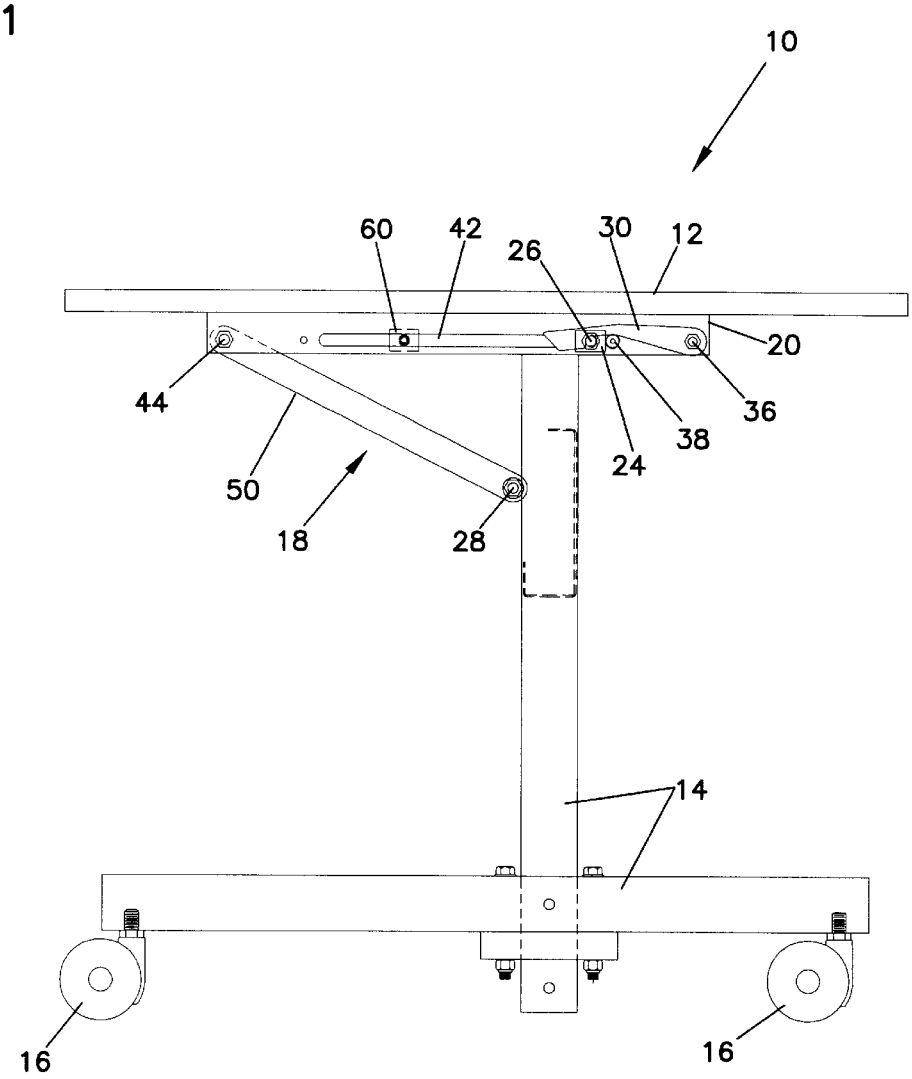
FIG. 1 shows an end elevational view of a folding table according to the principles of the present invention in an unfolded use position.

Referring now to the drawings, and in particular to FIG. 1, there is shown a folding table, generally designated 10. The folding table 10 may be used for room service deliveries or may be longer having extended area for other uses. The folding table 10 includes a table top 12 with a folding linkage 18 mounted to a frame 14. The table 10 is typically mounted on casters or rollers 16 to provide for ease of mobility.

Figure 2:
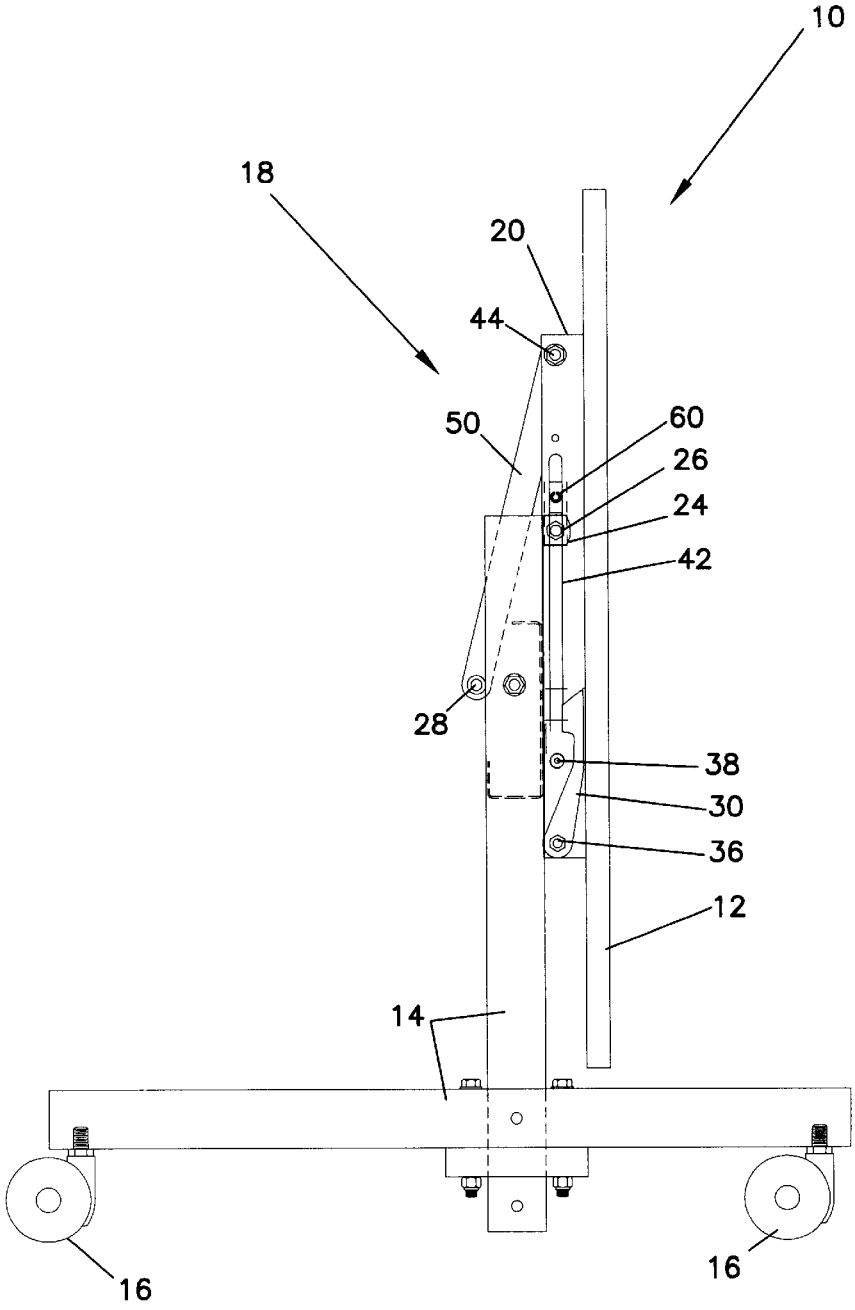
FIG. 2 shows an end elevation view of the folding table shown in FIG. 1 in a folded storage position.

As shown in FIG. 2, the linkage 18 provides for folding the table top 12 to a substantially vertical position for storage. At this position, the folded table 10 may be nested so that less floor space is required for storing the tables 10. Storage space becomes especially important when large numbers of folding tables 10 are used, such as in a room service operation of a large hotel.

Figure 3:
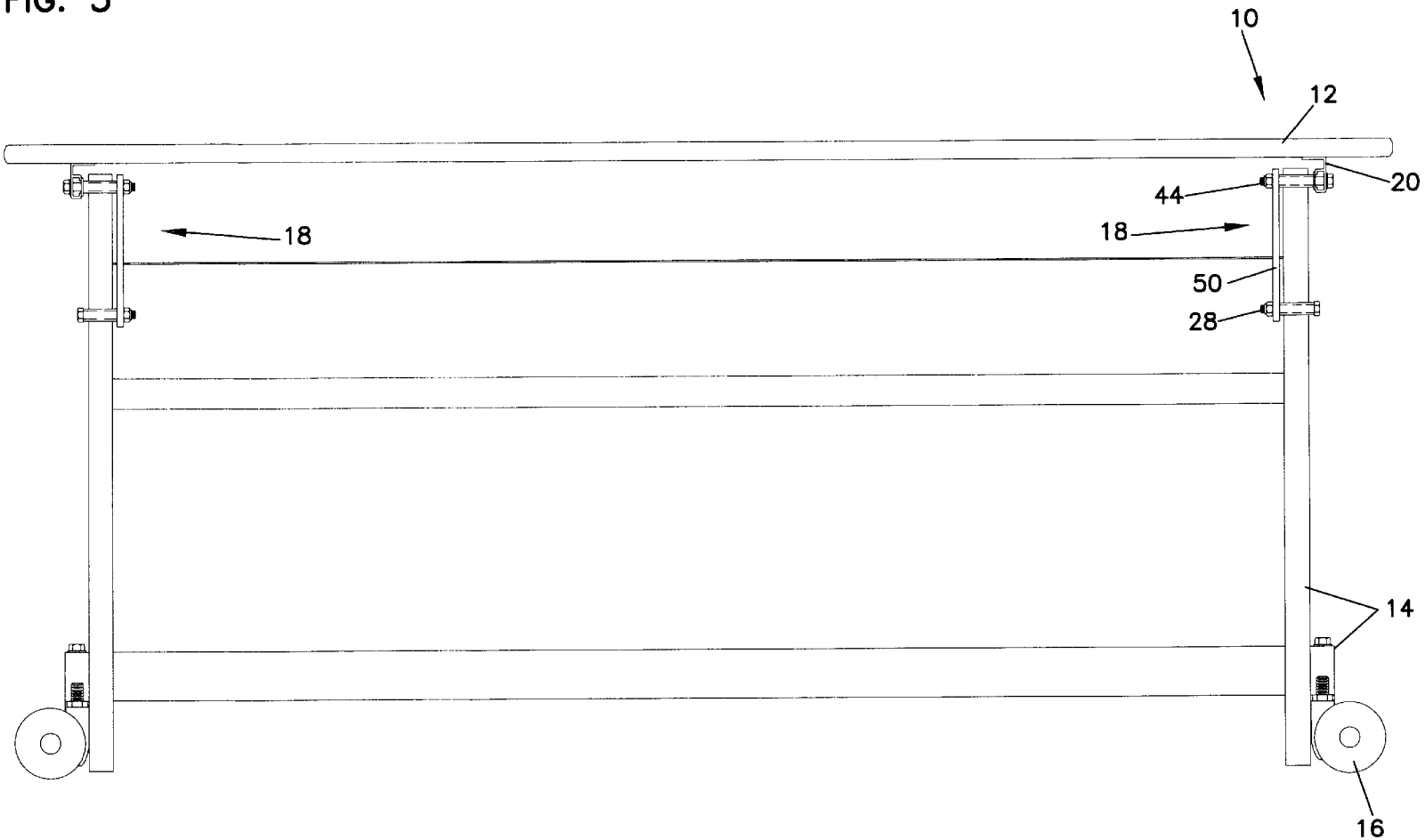
FIG. 3 shows a front elevational view of the folding table shown in FIG. 1.

As shown in FIG. 3, in a preferred embodiment, the folding table 10 includes two linkages 18, one associated with each upright portion of the frame 14 at the extended ends of the table top 12 having ranges of motion that mirror one another. With dual linkages, greater stability is provided for the table top 12, as support extends at both ends outward away from the frame 14 toward both sides of the table top. Referring again to FIG. 1, the linkage 18 includes a first link mounted to the underside of the table top 12 serving as a table top frame member 20. The table top frame member 20 includes a slot 42 formed therein and extending along a portion of the table top frame member 20, as shown more clearly in FIGS. 4 and 5. The table top frame member 20 also includes a c-channel 48 and a top flange 46 extending along the length of the frame member 20, as shown in FIGS. 6–9. The table top frame member 20 mounts to a pivot 26 extending through a mounting block 24 slidably mounted in the c-channel 48, as shown in FIG. 7. The pivot 26 extends through the slot 42 and moves along the slot as the mounting block 24 slides along the c-channel 48. The pivot 26 mounts to the frame 14 on a mounting arm 52 extending horizontally from the outright portion of the frame 14. The frame pivot 26 slides along the c-channel 48 and slot 42 from the first end, as shown in FIG. 1, to a position nearer to the second end, as shown in the folded position of FIG. 2. This motion allows the table top 12 to move between a substantially horizontal position and a substantially vertical position.

The folding linkage 18 has a pivot arm 50 which pivotally mounts at an upper end to a pivot 44 at an extended end of the table top frame member 20. The arm 50 mounts at its lower end to a pivot 28 mounted on the upright member of the table frame 14. This arrangement is also shown more clearly in FIG. 3.

Figure 4:
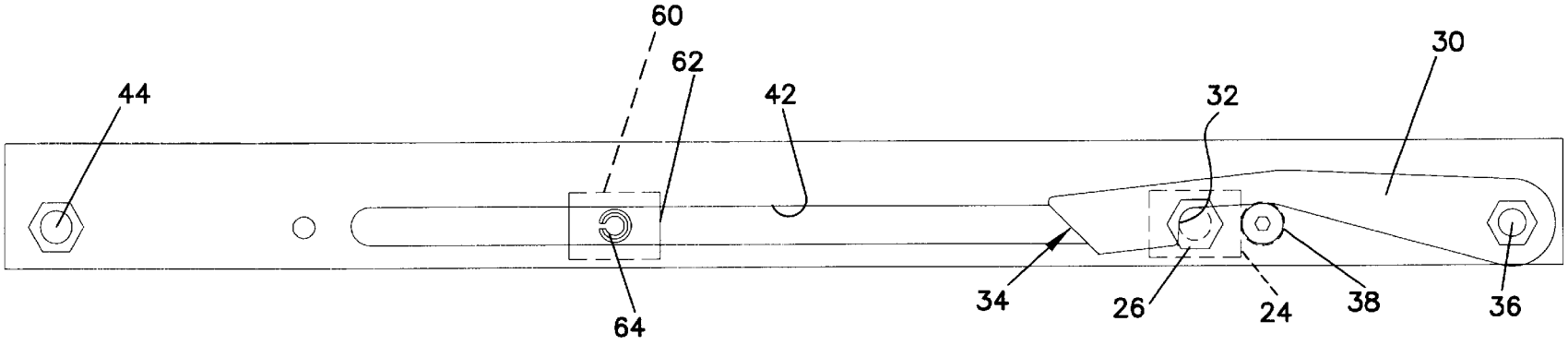
FIG. 4 shows a side view of the latching system for the folding table shown in FIG. 1 in a locked position.
Figure 5:
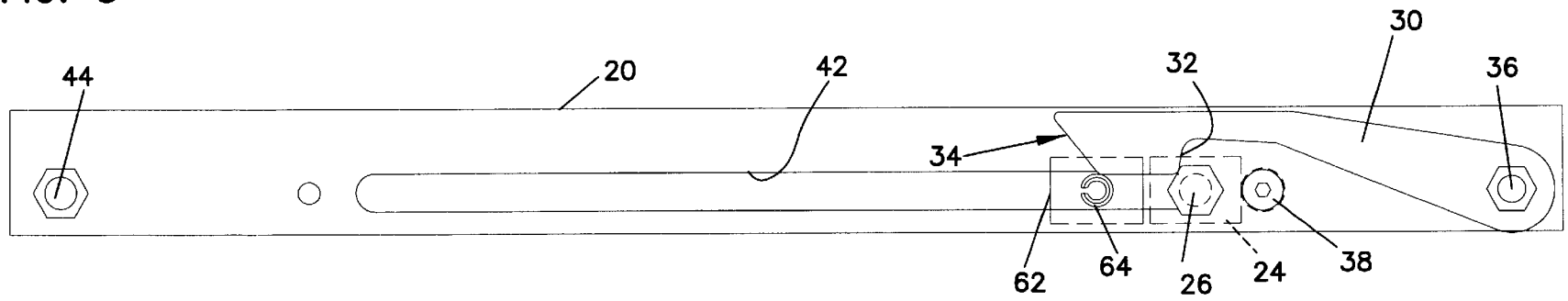
FIG. 5 shows a side view of the latching system shown in FIG. 4 in a disengaged position, ready for folding.
Figure 8:
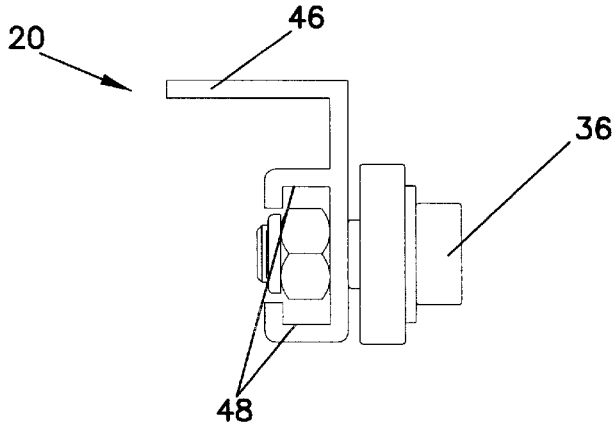
FIG. 8 shows a detail view of the pivotal mounting of the latch member to the table top frame member for the latching system shown in FIG. 4.
Figure 9:
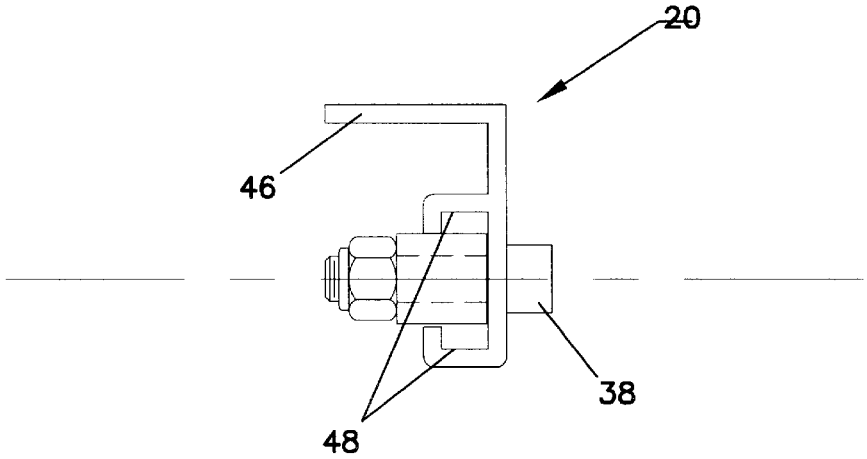
FIG. 9 shows a detail view of the mounting of the latch stop member to the table top frame member for the latching system shown in FIG. 4.

Referring now to FIGS. 4 and 5, each of the linkages 18 includes a latch 30 mounted on a pivot 36 to the first end of the table top frame member 20, as also shown in FIG. 8. The downward pivoting motion of the latch 30 is limited by a stop 38, as shown in FIG. 4, and its upward motion is limited by engagement with the underside of the table top 12. The stop 38 mounts to the table top frame member 20 to engage the underside of the latch 30, and is shown in FIG. 9. The latch 30 includes a hook portion 32 configured for engaging the frame pivot 24, as shown in FIG. 4. In the engaged position, the frame pivot block 24 does not slide along the c-channel 48, so that the table top 12 is maintained in a substantially horizontal position, as shown in FIG. 1. However, if the latch 30 is moved to the position shown in FIG. 5, the pivot 24 may slide along the c-channel 48 in its slot 42, so that the frame member 28 may move relative to the pivot 24 to the position shown in FIG. 2. Although the latch 30 can be lifted to this position manually, with two linkages 18, such action would require two people, as was required with the prior art latches.

Figure 6:
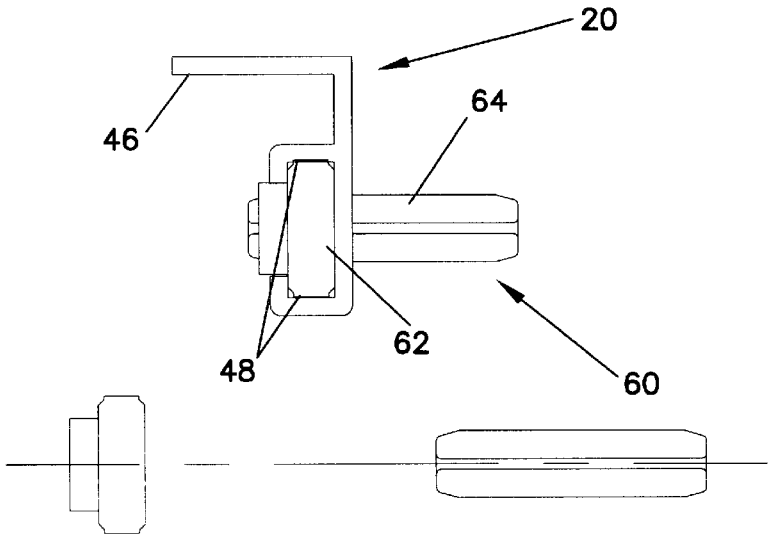
FIG. 6 shows a detail view of the slidable mounting of the latch holder to the table top frame member for the latching system shown in FIG. 4.
Figure 7:
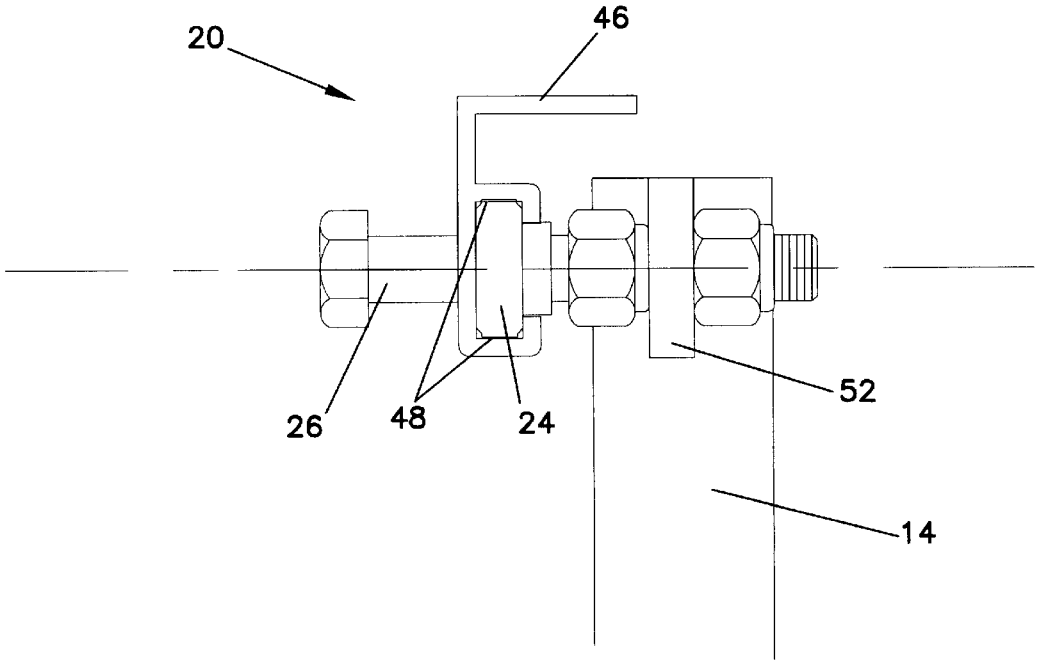
FIG. 7 shows a detail view of the pivotal mounting of the table top member frame to the upright frame member for the latching system shown in FIG. 4.

As shown in FIG. 6, a latch holder 60 including a sliding block 62 mounts in the c-channel 48 of the table top frame member 20. A holding strut 64 extends from the sliding block through the slot 42. The latch holder 60 slides in the same channel 48 and slot 42 as the pivot 26 and its mounting block 24. When the latch holder 60 is at position shown in FIG. 4, the latch 30 generally falls to the latched position and engages the frame pivot 24 under the force of gravity. In this position, the latch 30 is engaged and the table top 12 is maintained in the position shown in FIG. 1. However, when the latch holder 60 is slid toward a first end of the slot 42, the strut 64 engages an angled lift surface 34 on a leading edge of the latch 30. The latch holder 60 and lift surface 34 act as a wedge, so that as the latch holder 60 is pushed towards the latch pivot 36, the strut 64 moves along the lift surface 34 and the latch 30 is pushed upward, so that the retainer portion 32 is pushed upward and out of engagement with the frame pivot 26. At this position, the linkage 18 is unlatched and the table top 12 is free to move between the unfolded position, as shown in FIG. 1, and the folded position shown in FIG. 2.

With dual linkages 18, as shown in FIG. 3, once a first linkage 18 is moved to the position shown in FIG. 5, the second linkage 18 may still be latched. However, since the latch holder 60 will maintain the first latch 30 in the disengaged position, the second latch 30 may be manually disengaged and a single person may fold the table 10 to the position shown in FIG. 2 by merely holding the second latch 30 out of engagement with the pivot 26. Frictional resistance between the sliding block 62 and the c-channel 48 is sufficient to prevent the latch 30 from falling back to an engaged position, but does not affect the folding motion of the table 10.

It can also be appreciated that both of the linkages 18 may include a latch holder 60. With a dual latch holder configuration, either of the latches 30 may be moved to the disengaged position shown in FIG. 5 and retained and lifted by the latch holder 60. This configuration allows the operator to start at either end of the table 10, lifting the nearest latch 30, and moving to the other end for disengagement. Such a configuration also allows an operator to fold the table 10 at the center or other position remote from the linkages 18.

Referring again to FIG. 2, after the latches 30 has been disengaged, the table 10 may be folded. This motion slides the frame member 20, acting as a folding link, about the pivot 24 and downward. The latch holder 60 is pushed along the c-channel 48 away from engagement with the latch 30. The arm 50 pivots from an outwardly extended upward angling position shown in FIG. 1, to the position shown in FIG. 2, extending substantially vertically.

When the table top 12 must be moved from the folded storage position shown in FIG. 2, to the substantially horizontal use position shown in FIG. 1, the lower edge of the table top 12 is lifted, thereby sliding the frame member 20 along the pivot 24 until the hook portion 32 of the latch 30 engages the pivot 24. The folding operation moved the latch holder 60 further along the c-channel 48 and slot 42, so that it does not engage and/or lift the latch 30 when the table 10 is returned to the use position, shown in FIG. 1. Upon returning to the substantially horizontal position shown in FIG. 1, the latch 30 automatically engages the pivot 24 due to gravity.

It can be appreciated that the present invention provides for easy folding and unfolding of a dual linkage table 10 with the linkages 18 spaced too far apart for simultaneous operation by one person. The latch holder 60 of the present invention provides for maintaining one of the latches 30 in the disengaged position so that the other latch 30 may be manually operated. In addition, the system may use dual holders 60, one for each linkage 18, so that latching and unlatching may be accomplished starting at either end. Moreover, the linkage 18 automatically moves the holder 60 to a disengaged position so that the latch 30 automatically engages and secures when moved to the position shown in FIG. 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A folding linkage, comprising:

a base having a pivot;

a first link slidably and pivotally mounted to the base;

a second link pivotally mounted at a first end to the base and at a second end to the first link;

a movable retainer mounted to the first link member and engaging the pivot of the base at a first retainer position and disengaged from the pivot at a second retainer position;

a holder slidably mounted to the first link, and selectively engaging the retainer member to move the retainer member to the second retainer position.

2. A folding linkage according to claim 1, wherein the linkage folds between an unfolded position wherein the first link is substantially horizontal and a folded position, wherein the first link is substantially vertical.

3. A folding linkage according to claim 2, wherein the holder is above the pivot between the base and the first link in the folded position.

4. A folding linkage according to claim 1, wherein the retainer member extends into a sliding path of the holder.

5. A folding linkage according to claim 4, wherein the retainer member includes a holder engaging surface, wherein upon engagement with the holder, the retainer member is urged toward the second retainer position.

6. A folding linkage according to claim 1, further comprising a first and second retainer limiter which limit the retainer member to a predetermined range of motion between the first retainer position and the second retainer position, respectively.

7. A folding table, comprising:

a folding linkage having:

a base having a pivot;

a first link slidably and pivotally mounted to the base;

a second link pivotally mounted at a first end to the base and at a second end to the first link;

a movable retainer member mounted to the first link and engaging the pivot of the base at a first retainer position and disengaged from the pivot at a second retainer position;

a holder slidably mounted to the first link, and selectively engaging the retainer member to move the retainer member to the second retainer position;

a frame supporting the folding linkage; and a table top mounted to the first link and second link.

8. A folding table according to claim 7, further comprising a second linkage having a folding motion mirroring folding motion of the folding linkage.

9. A folding table according to claim 7, wherein the first link mounts to the underside of the table top.

10. A folding table according to claim 9, wherein the frame comprises a substantially vertical member.

11. A folding table according to claim 7, wherein the retainer member includes a holder engaging surface, wherein upon engagement with the holder, the retainer member is urged toward the second retainer position.

12. A folding table according to claim 7, further comprising a retainer limiter which, with the table top, limits the retainer member to a predetermined range of motion between the first retainer position and the second retainer position, respectively.

13. A folding table, comprising:

a first folding linkage having:

a base having a pivot;

a first link slidably and pivotally mounted to the base, a second link pivotally mounted at a first end to the base and at a second end to the first link, a movable retained member mounted to the first link and engaging the pivot of the base at a first retainer position and disengaged from the pivot at a second retainer position, a holder slidably mounted to the first link, and selectively engaging the retainer member to move the retainer member to the second retainer position;

a second folding linkage having:

a second base having a pivot;

a first link slidably and pivotally mounted to the second base, a second link pivotally mounted at a first end to the second base and at a second end to the first link of the second folding linkage, a movable retainer member mounted to the first link of the second folding linkage and engaging the pivot of the second base at a first retainer position and disengaged from the pivot of the second base at a second retainer position;

a frame supporting the first and second folding linkages;

a table top mounted to the first links of the first and second linkages.

14. A folding table according to claim 13, wherein the second linkage has a folding motion mirroring a folding motion of the first folding linkage.

15. A folding table according to claim 13, wherein the first links of the first and second folding linkages mount to the underside of the table top.

16. A folding table according to claim 15, wherein the frame comprises a substantially vertical member.

17. A folding table according to claim 13, wherein the retainer members each include a holder engaging surface, wherein upon engagement with the respective holder, the respective retainer member is urged toward the second retainer position.

18. A folding table according to claim 13, wherein each folding linkage further comprises a retainer limiter which, along with the table top, limits the motion of the respective retainer member within a predetermined range between the first retainer position and the second retainer position, respectively.

* * * * *